United States Patent [19]

Marx

[11] Patent Number: 4,969,235

[45] Date of Patent: Nov. 13, 1990

[54] MOTE KNIFE ASSEMBLY COOPERATING WITH A ROLLER OF A FIBER PROCESSING MACHINE

[75] Inventor: Hans-Jürgen Marx, Jüchen 2, Fed. Rep. of Germany

[73] Assignee: Trützschler GmbH & Co. KG, Mönchengladbach, Fed. Rep. of Germany

[21] Appl. No.: 385,353

[22] Filed: Jul. 27, 1989

[30] Foreign Application Priority Data

Jul. 27, 1988 [DE] Fed. Rep. of Germany ..... 3825419

[51] Int. Cl.[5] ..... D01G 15/40

[52] U.S. Cl. ..... 19/105; 19/107; 19/113; 19/104

[58] Field of Search ..... 19/100, 104, 105, 107, 19/108, 110, 113

[56] References Cited

U.S. PATENT DOCUMENTS

| | | | |
|---|---|---|---|
| Re. 16,463 | 11/1926 | Thoma | 19/105 |
| 457,512 | 8/1891 | Groves | 19/105 |
| 1,409,627 | 3/1922 | Wehli | 19/105 |
| 3,205,537 | 3/1962 | Reiterer | 19/105 |
| 3,483,598 | 12/1969 | Bryan, Jr. | 19/105 |
| 4,355,439 | 10/1982 | Estebanell | 19/105 |
| 4,379,357 | 4/1983 | Benere et al. | 19/105 |
| 4,527,307 | 7/1985 | Teichmann | 19/105 |
| 4,539,728 | 9/1985 | Portell | 19/105 |
| 4,797,980 | 1/1989 | Jagst | 19/107 |
| 4,805,267 | 2/1989 | Leifeld | 19/105 |

FOREIGN PATENT DOCUMENTS

| | | |
|---|---|---|
| 32783 | 3/1967 | Japan . |
| 2083848 | 3/1982 | United Kingdom . |
| 2191514 | 12/1987 | United Kingdom . |
| 2205590 | 12/1988 | United Kingdom . |

*Primary Examiner*—Werner H. Schroeder
*Assistant Examiner*—Michael A. Neas
*Attorney, Agent, or Firm*—Spencer & Frank

[57] ABSTRACT

A textile fiber processing machine has a clothed roller, a clothed stationary carding element cooperating with the clothed roller, a mote knife cooperating with the clothed roller, a stationary component situated adjacent the circumferential periphery of the clothed roller and having a bounding edge defining, together with the mote knife, a waste removal clearance; and a carrier element disposed radially adjacent the roller periphery. The mote knife and the stationary carding element are mounted on and supported by the carrier element which is arcuately shiftable, together with the mote knife and the stationary carding element as a unit, in a direction parallel to the roller periphery, thereby varying the width of the waste removal clearance.

5 Claims, 2 Drawing Sheets

1
2
3
4
5
6
7
8
9
10
11
12
13
14
15
16
17
18
19
20
A
M

MOTE KNIFE ASSEMBLY COOPERATING WITH A ROLLER OF A FIBER PROCESSING MACHINE

CROSS REFERENCE TO RELATED APPLICATION

This application claims the priority of Federal Republic of Germany Application No. P 38 25 419.0 filed July 27, 1988, which is incorporated herein by reference.

BACKGROUND OF THE INVENTION

This invention relates to a mote knife assembly for a carding machine, a cleaning machine or a similar fiber processing machine, particularly for cotton fibers. The machine is of the type which has at least one roller provided with a clothing (hereafter clothed roller) such as a licker-in or the like with which there is associated a mote knife for separating impurities from the fiber and has at least one stationary clothed carding element.

In a known device of the above-outlined type the mote knife has to be adjusted relative to the clothed roller when the waste removal clearance and thus the degree of waste separation is to be altered. After such an alteration, the separately mounted mote knife has to be reset to the precise distance from the clothed roller in the second plane. Such a setting is time-consuming and constitutes a source of error. The impurities separated by the mote knife drop into a chamber which is situated underneath the licker-in and from which the waste is removed. Thus, in the prior art arrangements for each alteration of the setting for waste removal, different suction conditions occur in the zone of the waste removal clearance.

SUMMARY OF THE INVENTION

It is an object of the invention to provide a mote knife assembly of the above-outlined type from which the discussed disadvantages are eliminated and which, in particular, makes possible a more simple setting in case the waste removal clearance is to be altered.

This object and others to become apparent as the specification progresses, are accomplished by the invention, according to which, briefly stated, the mote knife and the stationary carding element are mounted on a common carrier which is shiftable parallel to the circumference of the roller with which it cooperates and further, the distance between the mote knife and a stationary cover element is adjustable.

By virtue of the fact that the carrier is adjustable parallel to the circumference of the roller, an individual setting of the mote knife in its distance relative to the roller may be dispensed with. The distance of the carrier from the roller remains constant. The width of the waste removal clearance, that is, the distance of the mote knife from the stationary cover element may be varied in a simple manner.

According to a further feature of the invention, a suction chamber is, together with the mote knife and the stationary carding element arranged on the common carrier. By virtue of this arrangement, the suction conditions in every waste removal setting of the mote knife remain the same. The suction chamber is arranged immediately upstream of the mote knife (as viewed in the direction of rotation of the clothed roller) so that the waste may be exposed to suction directly and in a locally defined manner. By virtue of the fact that the mote knife, the suction chamber and the carding element form a single unit, upon adjusting the degree of waste removal, all elements are moved to the same extent relative to the clothed roller. Thus only a single setting is necessary in order to alter the degree of waste removal.

Expediently, the mote knife and the suction chamber are formed as a one-piece unit. Preferably, the carrier may be shifted by a setting device and may be immobilized in the desired position. Preferably, the setting device has a driving mechanism such as a motor.

According to a further advantageous feature of the invention, a plurality of mote knives, stationary carding elements and suction chambers are mounted on the carrier.

DESCRIPTION OF THE PREFERRED EMBODIMENTS

Figure 1:
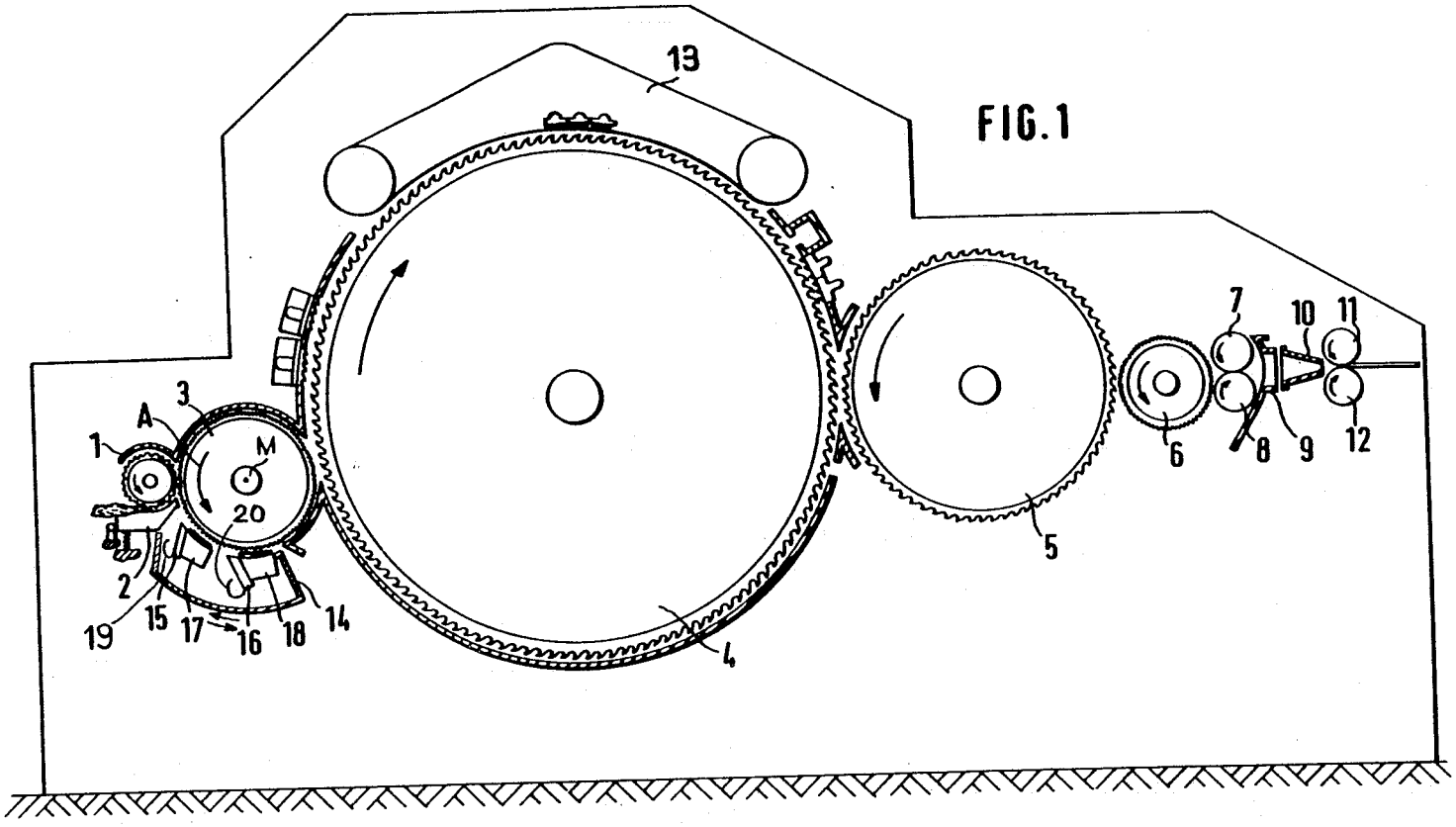
FIG. 1 is a schematic side elevational view of a carding machine incorporating a preferred embodiment of the invention.

Turning now to FIG. 1, there is illustrated therein a carding machine which may be an EXACTACARD DK 740 model manufactured by Trützschler GmbH & Co. KG, Mönchengladbach, Federal Republic of Germany. The carding machine has a feed roller 1, a feed table 2, a licker-in 3, a main carding cylinder 4, a doffer 5, a stripping roller 6, crushing rollers 7, 8, a web guiding element 9, a sliver trumpet 10, calender rollers 11, 12 and travelling flats 13.

Underneath the licker-in 3 there is arranged a carrier element 14 on which there are mounted two mote knives 15, 16 and two stationary carding elements 17, 18. With the mote knives 15 and 16 there are associated respective suction chambers 19, 20, which, as viewed in the direction of rotation of the licker-in 3 (arrow A) are arranged upstream of the associated mote knives 15 and 16 and are also mounted on the common carrier 14. The suction chambers 19 and 20 are connected to non-illustrated suction devices. The adjustability of the carrier 14 relative to the licker-in 3 will be described in conjunction with FIGS. 2 and 3. The distance of the mote knife 15 is varied relative to the stationary feed table 2, whereby the width of the waste removal clearance may be varied.

Figure 2:
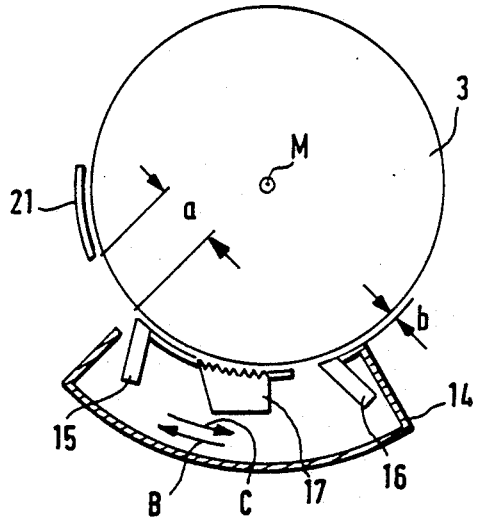
FIG. 2 is a schematic side elevational view, on an enlarged scale, of the preferred embodiment.

Also referring to FIG. 2, the carrier 14 is shiftable about the axis M of the licker-in 3 in the direction of the arrows B and C. Thus, carrier 14 which is arcuate and whose curvature is concentric with the licker-in axis M, is movable about the axis M parallel to the circumferential surface of the licker-in 3. A stationary component (covering housing part) is designated at 21. The distance a between the bounding edge of the housing part 21 and the cutting edge of the mote knife 15 determines the width of the waste removal gap 22. To vary the distance a, the housing 14 is shifted arcuately (about the licker-in axis M), whereby the position of the mote knife 15—which, together with the mote knife 16 and the stationary carding element 17, is secured to the housing 14—changes relative to the housing part (cover element) 21.

Figure 3:
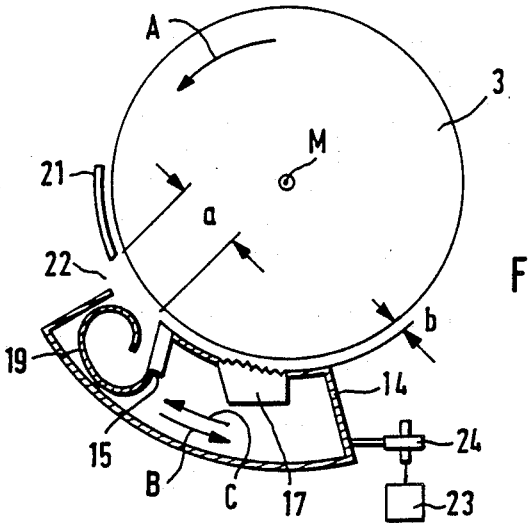
FIG. 3 is a schematic side elevational view of another preferred embodiment of the invention.

In the embodiment illustrated in FIG. 3, a motor 23 cooperates with a gear 24 to move the carrier 14 in the direction of arrows B or C. The carrier 14, together with the mote knives 15 and 16 and the stationary carding element 17 is guided about the licker-in 3 concentrically therewith so that the distance b of the carrier 14 (and thus the elements 15, 16 and 17) from the licker-in 3 does not change when an adjustment of the waste removal opening 22 in the direction B or C occurs and thus a change in the waste removal degree is effected. Since all the elements 15, 16 and 17 form a single unit on the carrier 14, upon adjustment of the separating degree, all elements 15, 16 and 17 are shifted in unison to the same extent about the licker-in 3, parallel to the circumference thereof. In this way, advantageously, only a single setting is necessary in order to alter the waste removal characteristics. The suction chamber 19 also moves with the housing 14 as a unit and thus its radial distance from the licker-in 3 remains constant. By virtue of this arrangement the suction conditions remain the same for each setting of the degree of waste removal.

It will be understood that the above description of the present invention is susceptible to various modifications, changes and adaptations, and the same are intended to be comprehended within the meaning and range of equivalents of the appended claims.

What is claimed is:

1. In a textile fiber processing machine including a clothed roller having a circumferential periphery and an operational direction of rotation, a clothed stationary carding element cooperating with the clothed roller, a mote knife cooperating with the clothed roller and a stationary component situated adjacent said circumferential periphery and having a boundary edge defining, together with said mote knife, a waste removal clearance having a width measured circumferentially, parallel to said circumferential periphery; the improvement comprising a carrier element disposed radially adjacent said circumferential periphery; said mote knife and said stationary carding element being mounted on and supported by said carrier element; and adjusting means for arcuately adjusting said carrier element together with said mote knife and said stationary carding element as a unit, in a direction parallel to said circumferential periphery, for varying said width.

2. A textile fiber processing machine as defined in claim 1, further comprising means defining a suction chamber mounted on said carrier member upstream of said mote knife as viewed in said operational direction of rotation.

3. A textile fiber processing machine as defined in claim 2, wherein said mote knife and said means defining a suction chamber form a single-piece compartment.

4. A textile fiber processing machine as defined in claim 1, wherein said adjusting means comprises a motor operatively connected to said carrier for shifting said carrier.

5. A textile fiber processing machine as defined in claim 2, further wherein said clothed stationary carding element, said mote knife and said suction chamber are each present in a plurality; said waste removal clearance being defined between said stationary component and one of the mote knives situated adjacent the stationary component.

* * * * *